US006666271B2

(12) United States Patent
Deaton et al.

(10) Patent No.: US 6,666,271 B2
(45) Date of Patent: Dec. 23, 2003

(54) CURVED FLAPPER AND SEAT FOR A SUBSURFACE SAFTEY VALVE

(75) Inventors: Thomas M. Deaton, Houston, TX (US); Robert Allen Jancha, Humble, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 52 days.

(21) Appl. No.: 09/998,800

(22) Filed: Nov. 1, 2001

(65) Prior Publication Data

US 2003/0079880 A1 May 1, 2003

(51) Int. Cl.[7] ..... E21B 34/14; E21B 34/00; F16K 31/12

(52) U.S. Cl. ..... 166/332.8; 166/320; 166/321; 251/63.4

(58) Field of Search ..... 137/527; 166/316, 166/319, 320, 321, 332.1, 332.8; 251/63.4, 303

(56) References Cited

U.S. PATENT DOCUMENTS

| | | | | | |
|---|---|---|---|---|---|
| 3,796,257 | A | | 3/1974 | Hudson | 166/0.5 |
| 3,799,204 | A | | 3/1974 | Watkins et al. | 137/629 |
| 3,830,297 | A | | 8/1974 | Cockrell | 166/224 S |
| 3,845,818 | A | | 11/1974 | Deaton | 166/224 S |
| 3,850,242 | A | | 11/1974 | Crowe | 166/224 A |
| 3,854,502 | A | | 12/1974 | Mott | 137/629 |
| 4,103,744 | A | | 8/1978 | Akkerman | 166/324 |
| 4,140,153 | A | | 2/1979 | Deaton | 137/629 |
| 4,415,036 | A | | 11/1983 | Carmody et al. | 166/324 |
| 4,452,311 | A | | 6/1984 | Speegle et al. | 166/324 |
| 4,454,913 | A | | 6/1984 | Guidry et al. | 166/117.5 |
| 4,478,286 | A | | 10/1984 | Fineberg | 166/324 |
| 4,629,002 | A | | 12/1986 | Pringle | 166/324 |
| 4,709,762 | A | | 12/1987 | Pringle | 166/324 |
| 4,716,968 | A | | 1/1988 | Pringle | 166/319 |
| 4,722,399 | A | | 2/1988 | Pringle | 166/324 |
| 4,926,945 | A | * | 5/1990 | Pringle et al. | 166/321 |
| 5,058,682 | A | | 10/1991 | Pringle | 166/324 |
| 5,125,457 | A | * | 6/1992 | Meaders | 251/63.4 |
| 5,170,845 | A | | 12/1992 | Gay et al. | 166/374 |
| 5,205,355 | A | | 4/1993 | Gay et al. | 166/72 |
| 5,503,229 | A | | 4/1996 | Hill, Jr. et al. | 166/324 |
| 5,682,921 | A | * | 11/1997 | Rawson et al. | 166/332.8 |
| 5,752,569 | A | | 5/1998 | Bhavsar et al. | 166/324 |
| 5,862,864 | A | | 1/1999 | Whiteford | 166/321 |
| 5,884,705 | A | | 3/1999 | Hill, Jr. | 166/324 |
| 5,996,687 | A | | 12/1999 | Pringle et al. | 166/66.6 |
| 6,289,926 | B1 | * | 9/2001 | Dennistoun | 166/332.8 |
| 6,296,061 | B1 | * | 10/2001 | Leismer | 166/332.8 |
| 2002/0153143 | A1 | * | 10/2002 | Compton et al. | 166/321 |

* cited by examiner

*Primary Examiner*—David Bagnell
*Assistant Examiner*—Brian Halford
(74) *Attorney, Agent, or Firm*—Moser, Patterson & Sheridan, L.L.P.

(57) ABSTRACT

The invention is generally directed to a curved flapper and seat for use in a subsurface safety valve. The flapper is biased to a normally closed position to prevent fluid flow through the wellbore. The curved flapper has a sealing surface for engaging a corresponding sealing surface on a seat when the flapper is in its closed position. The sealing surface of the flapper is configured to contact the sealing surface of the seat along a sinusoidal sealing line, or seam, such that the reactive force from the seat is normal to the sinusoidal seating line. In one aspect, the sealing surface of the flapper has a convex spherical configuration relative to the seat. The sealing surface of the seat, in turn, has a concave conical shape relative to the flapper. When well conditions dictate, a resilient soft seat may optionally be used, and is disposed on the seat proximate the sinusoidal seating line.

54 Claims, 14 Drawing Sheets

CURVED FLAPPER AND SEAT FOR A SUBSURFACE SAFTEY VALVE

BACKGROUND OF THE INVENTION

1. Field of the Invention

This invention is related generally to safety valves. More particularly, this invention pertains to subsurface safety valves which employ a curved flapper for controlling fluid flow through a production tubing string.

Surface controlled, subsurface safety valves (SCSSVs) are commonly used to shut in oil and gas wells. Such SCSSVs are typically fitted into production tubing in a hydrocarbon producing well, and operate to block the flow of formation fluid upwardly through the production tubing should a failure or hazardous condition occur at the well surface.

SCSSVs are typically configured as rigidly connected to the production tubing (tubing retrievable), or may be installed and retrieved by wireline, without disturbing the production tubing (wireline retrievable). During normal production, the subsurface safety valve is maintained in an open position by the application of hydraulic fluid pressure transmitted to an actuating mechanism. The hydraulic pressure is commonly supplied to the SCSSV through a control line which resides within the annulus between the production tubing and a well casing. The SCSSV provides automatic shutoff of production flow in response to one or more well safety conditions that can be sensed and/or indicated at the surface. Examples of such conditions include a fire on the platform, a high/low flow line pressure condition, a high/low flow line temperature condition, and operator override. These and other conditions produce a loss of hydraulic pressure in the control line, thereby causing the flapper to close so as to block the flow of production fluids up the tubing.

2. Description of the Related Art

Most surface controlled subsurface safety valves are "normally closed" valves. This means that the valves utilize a flapper type closure mechanism which is biased in its closed position. In many commercially available valve systems, the bias is overcome by longitudinal movement of a hydraulic actuator. In some cases the actuator of the SCSSV comprises a concentric annular piston Most commonly, the actuator comprises a small diameter rod piston located in a housing wall of the SCSSV.

During well production, the flapper is maintained in the open position by a flow tube connected downhole to the actuator. From a reservoir, a pump at the surface delivers regulated hydraulic fluid under pressure to the actuator through a control conduit, or control line. Hydraulic fluid is pumped into a variable volume pressure chamber (or cylinder) and acts against a seal area on the piston. The piston, in turn, acts against the flow tube to selectively open the flapper member in the valve. Any loss of hydraulic pressure in the control line causes the piston and actuated flow tube to retract, which causes the SCSSV to return to its normally closed position by a return means. The return means serves as the biasing member, and typically defines a powerful spring and/or gas charge. The flapper is then rotated about a hinge pin to the valve closed position by the return means, i.e., a torsion spring, and in response to upwardly flowing formation fluid.

In some wells, high fluid flow rates of as much as 250 million cubic feet or more per day of gas may be produced through the SCSSV. In high flow rate wells, it is well known that curved or arcuate flappers may be used to provide a larger inside diameter, or bore, in the SCSSV as compared to a flat flapper. Examples of such SCSSVs are described in U.S. Pat. Nos. 2,162,578; 4,531,587; 4,854,387; 4,926,945; 5,125,437; and 5,323,859. Curved flapper arrangements enable a larger production tubing inner diameter and, thus, allow for a greater rate of hydrocarbon production through the valve area.

In either flat or curved flappers, as the tubular piston and operator tube retract, the flapper closure passes across the lower end of the operator tube and throttles the flow as it rotates toward the closed or "seated" position. At high flow rates, a high differential pressure may be developed across the flapper that may cause distortion and warping of the flapper as it rubs against the operator tube. Also, a flapper seat may be damaged if it is slammed open against the valve housing or slammed shut against the valve seat in response to the high-pressure differentials and production flow regimes. Damage to the flapper seat or leakage around the flapper may also occur if the flapper is closed on any debris in the well, such as sand or other aggregate that may be produced with the hydrocarbons.

In prior art SCSSVs, the flapper is seated in a variety of configurations. The flapper may be seated against an annular sealing face, either in metal-to-metal contact, or metal against an annular resilient seal.

In U.S. Pat. No. 3,955,623 discloses a flapper having a flat, annular sealing face. The flapper is engagable against a flat, annular valve seat ring, with sealing engagement being enhanced by an elastomeric seal ring that is mounted on the valve seat.

U.S. Pat. No. 4,457,376, the valve seat includes a downwardly facing, conical segment having a sloping sealing surface. The flapper closure member has a complimentary, sloping annular sealing surface that is adapted for surface-to-surface engagement against the conical valve seat surface.

U.S. Pat. No. 5,125,457, (expired) also presents a curved flapper. The flapper has a sealing surface with a convex spherical radius which seats in a matching concave housing. It also has a concave spherical portion constructed of an elastomeric material. The spherical radius flapper/seat has an alternate embodiment shown in U.S. Pat. No. 5,323,859. This patent teaches metal-to-metal sealing surfaces with no resilient seal.

In U.S. Pat. Nos. 5,682,921, and 5,918,858 a flat sealing surface is provided on both the flapper and the seat, fashioned in a sinusoidal undulating shape and having a combination metal and resilient seal.

In all these arrangements, the flapper rotates about a hinge assembly that comprises a hinge pin and a torsion spring. It will be appreciated by those of ordinary skill in the art, that structural distortion of the flapper, or damage to the hinge assembly which supports the flapper for rotational movement into engagement with the valve seat, can cause misalignment of the respective sealing surfaces, thereby producing a leakage path around the flapper.

Misalignment of the flapper relative to the valve seat may also be caused by the deposition of sand particles or other debris on the valve seat and/or sealing surfaces. Sand may be produced in both gas and oil wells, under low flow rate conditions as well as high flow rate conditions. It is particularly difficult to obtain positive sealing engagement of either flat or curved flappers and valve seats in low-pressure, sandy environments.

The integrity of the sealing engagement between the flapper and valve seat may be compromised under low flow rate conditions, while the same safety valve may provide positive closure and sealing engagement under high flow rate, high differential pressure conditions In this respect, slight misalignment may be overcome by high-pressure impact and engagement of the flapper against the valve seat. However, the same misalignment may produce a leakage path under low differential pressure conditions. Such misalignment will prevent correct seating and sealing of the flapper. The result is that a large amount of formation fluid may escape through the damaged valve, wasting valuable hydrocarbon resources, causing environmental pollution, and creating potentially hazardous conditions for well operations personnel. During situations involving damage to the wellhead, the well flow must be shut off completely before repairs can be made and production resumed. Even a small leak through the flapper safety valve in a gas well can cause catastrophic damage.

The following U.S. patents pertain to SCSSVs having flapper closure mechanisms and are hereby incorporated by reference: U.S. Pat. Nos. 3,788,595; 3,865,141; 3,955,623; 4,077,473; 4,160,484; 4,161,960; 4,287,954; 4,376,464; 4,449,587; 4,457,376; 4,531,587; 4,583,596; 4,605,070; 4,674,575; 4,854,387; 4,890,674; 4,926,945; 4,983,803; 4,986,358; 5,125,457; 5,137,090; 5,263,847; 5,323,859; 5,423,383; 5,285,851; 5,918,858; 5,682,921.

SUMMARY OF THE INVENTION

The present invention provides an improved flapper and seat for a surface controlled subsurface safety valve (SCSSV). The SCSSV of the present invention provides a curved flapper having a novel sealing surface for engaging a novel corresponding sealing surface in the seat. The sealing surface of the flapper is configured to contact the sealing surface of the seat along a sinusoidal sealing line, or seam, such that the reactive force from the seat is normal to the sinusoidal seating line. Thus, a more effective seal is achieved when the flapper pivots to its closed position. In operation, the novel SCSSV will safely and effectively shut in a well below the earth's surface in the event of damage to the wellhead or flow line, or in the event of a malfunction of any surface equipment, with the shut-in being accomplished whether the well is operating in low flow or in high flow conditions.

The present invention also provides an improved surface-controlled, subsurface flapper safety valve in which the flapper closure mechanism and valve seat are tolerant of irregularities, such as obstructions or surface distortions caused by sand deposits or erosion of their respective sealing surfaces. The present invention also provides an improved flapper mechanism and seat in an SCSSV assembly having, in one embodiment, a flapper having a spherical sealing surface, and a corresponding metallic seat having a conical sealing surface. In one aspect, the sealing surface of the flapper has a convex spherical configuration relative to the seat. The sealing surface of the seat, in turn, has a concave conical shape relative to the flapper. In such an arrangement, the present invention provides an improved valve seat for an SCSSV adapted to provide a positive seal against a curved or arcuate flapper closure mechanism to overcome imperfect alignment or surface finish of its sealing surface relative to the safety valve seat.

The present invention also provides an improved flapper mechanism and seat in an SCSSV assembly having, in another embodiment, a flapper having a spherical sealing surface, and a corresponding metallic "hard" seat having a conical sealing surface. Disposed concentrically within the hard seat is also a "soft" valve seat made of a yieldable material such as an elastomer (nitrile, neoprene, AFLAS®, KALREZ®), a thermoplastic polymer (TEFLON®, RYTON®, or PEEK®), or a soft metal (lead, copper, zinc and brass). The soft seat defines a concave spherical or conical segment. The surfaces of the hard seat and the soft seat are configured to lie in sealable contact within the spherical radius that defines the sealing surface on the flapper. The surfaces are configured to provide a positive seal along a continuous interface seam between the conical hard seat, the (optional) resilient soft seat and the concave spherical sealing surface of the flapper.

According to the foregoing alternative arrangement, a convex spherical sealing segment of the flapper is received in nesting engagement against the surface of the soft seat, and against the conical sealing segment of the hard seat. The nesting arrangement allows for some misalignment of the flapper relative to the valve seat without interrupting surface-to-surface engagement therebetween. In this respect, the surface of the soft seat will tolerate a limited amount of angular misalignment of the flapper that might be caused by structural distortion of the closure or deflection of the hinge assembly, enabling a low-pressure seal. Line contact between the convex spherical segment of the flapper and the conical hard seat serves to realign the flapper as pressure increases. The hard seat also supplies sufficient structural rigidity to enable a pressure seal at high pressures. Positive sealing engagement between the flapper and the hard and soft seats is also obtained in sandy environments by engagement of the yieldable seat which conforms about surface irregularities which may be caused by surface deposits or surface erosion caused by the production of sandy fines.

It will be appreciated by one of ordinary skill in the art, that the foregoing net result of this interaction, is a flapper and seat system that performs in a sandy environment throughout any pressure range required in a hydrocarbon producing well for both tubing retrievable and wireline retrievable SCSSVs, and for both hydraulic or electrically actuated embodiments thereof.

As has been described in detail above, the present invention has been contemplated to overcome the deficiencies of the prior equalizing safety valves specifically by disclosing significant improvements to the flapper closure mechanism and the corresponding seat. The novel features of the invention are set forth with particularity in Detailed Description of Preferred Embodiments and The Claims. The invention will best be understood from the following description when read in conjunction with the accompanying drawings.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
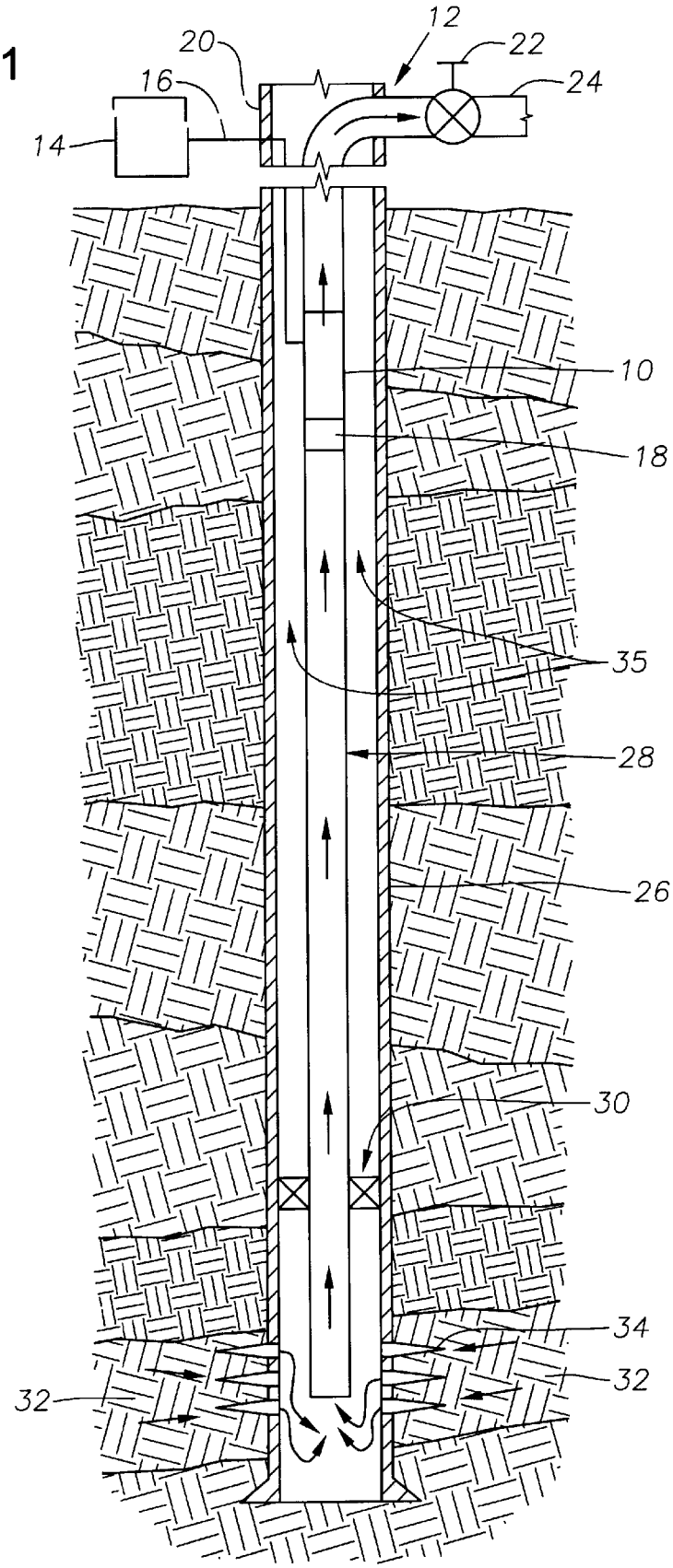
FIG. 1 is a semi-diagrammatic schematic, in cross section, of a typical production well having a surface controlled, tubing retrievable subsurface safety valve installed according to the present invention.

In the description that follows, like parts are marked throughout the specification and drawings with the same reference numerals, respectively. The drawings may be but are not necessarily to scale and the proportions of certain parts have been exaggerated to better illustrate details and features of the invention. One of normal skill in the art of subsurface safety valves will appreciate that the present invention can and may be used in all types of subsurface safety valves, including but not limited to tubing retrievable, wireline retrievable, injection valves, subsurface controlled valves (such as storm chokes), or any type of flapper safety valve that benefits from a larger flow area by the employment of a curved or arcuate flapper closure mechanism.

Referring now to FIG. 1, a subsurface safety valve 10 is shown in place in a typical well completion schematic 12. A land well is shown for the purpose of illustration; however, it is understood that a subsurface safety valve 10 of the present invention may be commonly used in offshore wells. Visible in the well 12 of FIG. 1 are a wellhead 20, a master valve 22, a flow line 24, a casing string 26, production tubing 28, and a packer 30. In operation, opening the master valve 22 allows pressurized hydrocarbons residing in the producing formation 32 to flow through a set of perforations 34 and into the well 12. The packer 30 seals an annulus 35 between the casing 26 and the production tubing 28 in order to direct the flow of hydrocarbons. Hydrocarbons (illustrated by arrows) flow into the production tubing 28, through the subsurface safety valve 10, through the wellhead 20, and out into the flow line 24.

Figure 2:
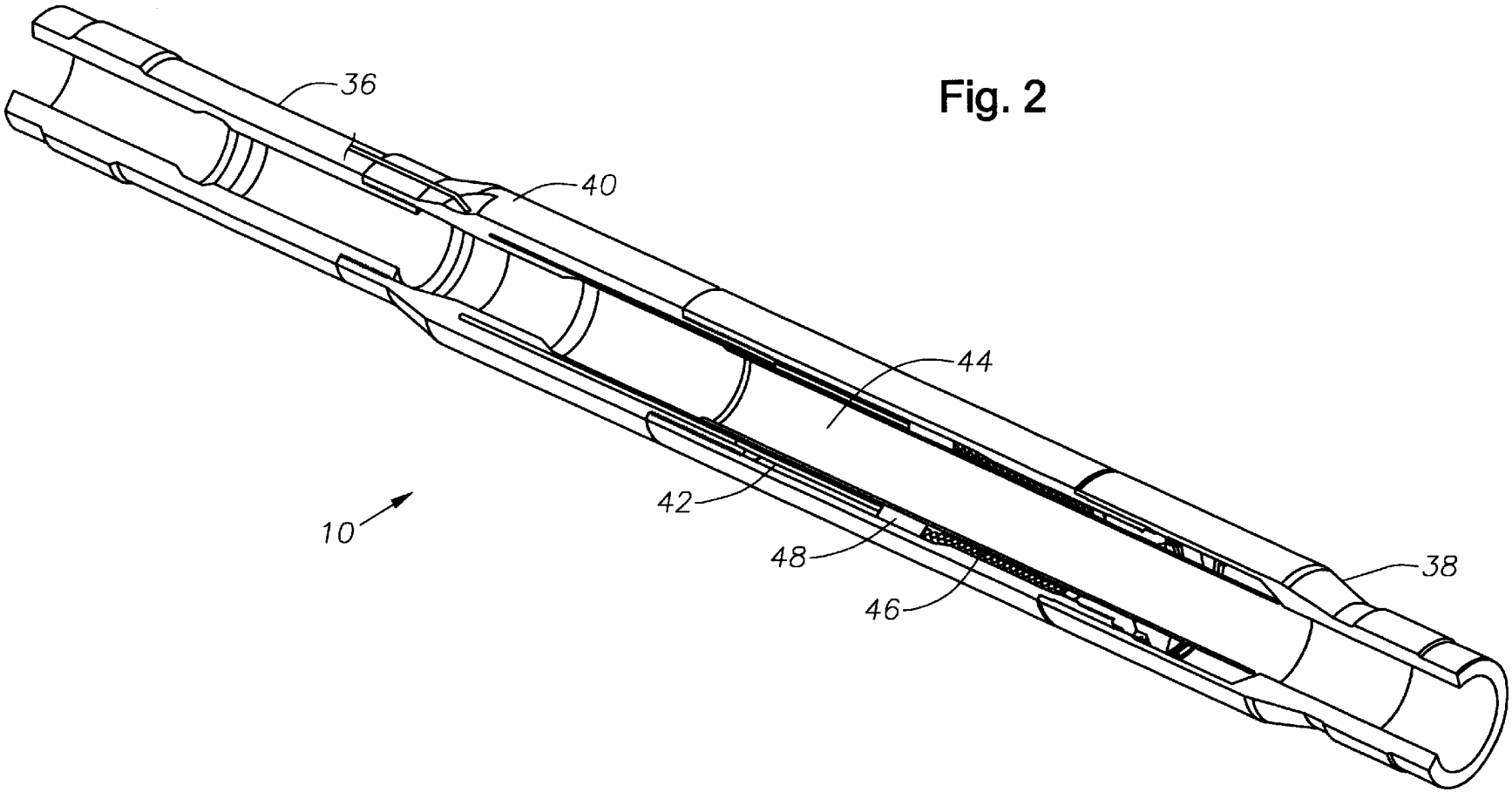
FIG. 2 is an isometric view, in partial section, of a tubing retrievable subsurface safety valve of the present invention shown in the open position.

Referring now to FIG. 2, a subsurface safety valve 10 of the present invention is shown in the open position. An upper nipple 36 and a lower sub 38 serve to sealingly connect the safety valve 10 to the production tubing 28. The safety valve 10 is maintained in the open position by hydraulic pressure. Hydraulic pressure is supplied by a pump (not shown) in a control panel 14 through a control line 16 to the safety valve 10. The hydraulic pressure holds a flapper closure mechanism 18 within the safety valve 10 in the open position. Because the safety valve 10 is a "fail closed" device, loss of hydraulic pressure in the control line 16 will cause the flapper closure mechanism 18 to actuate, thereby blocking the upward flow of hydrocarbons to the surface.

As noted, the safety valve 10 shown in FIGS. 1 and 2 is hydraulically actuated. In this respect, the safety valve 10 includes a hydraulic chamber housing 40 and a piston 42 therein. The piston 42 is typically a small diameter piston which moves within a bore of the housing 40 in response to hydraulic pressure from the surface. Alternatively, the piston may be a large concentric piston which is pressure actuated. It is within the scope of the present invention, however, to employ other less common actuators such as electric solenoid actuators, motorized gear drives and gas charged valves (not shown). Any of these known or contemplated means of actuating the subsurface safety valve 10 of the present invention may be used.

Energizing the actuating means 42 serves to open the subsurface safety valve 10. In the arrangement of the safety valve 10 shown in FIG. 2, the application of hydraulic pressure through the control line 16 serves to force the piston 42 within the chamber housing 40 downward. The piston 42, in turns, acts upon a flow tube 44, translating the flow tube 44 longitudinally. In FIG. 2, the flow tube 44 is shown shifted fully downward due to the energy from the actuating means 42. In this position, the flow tube maintains the flapper closure mechanism 18 (obscured by flow tube 44 in this figure) in an open position.

Figure 3:
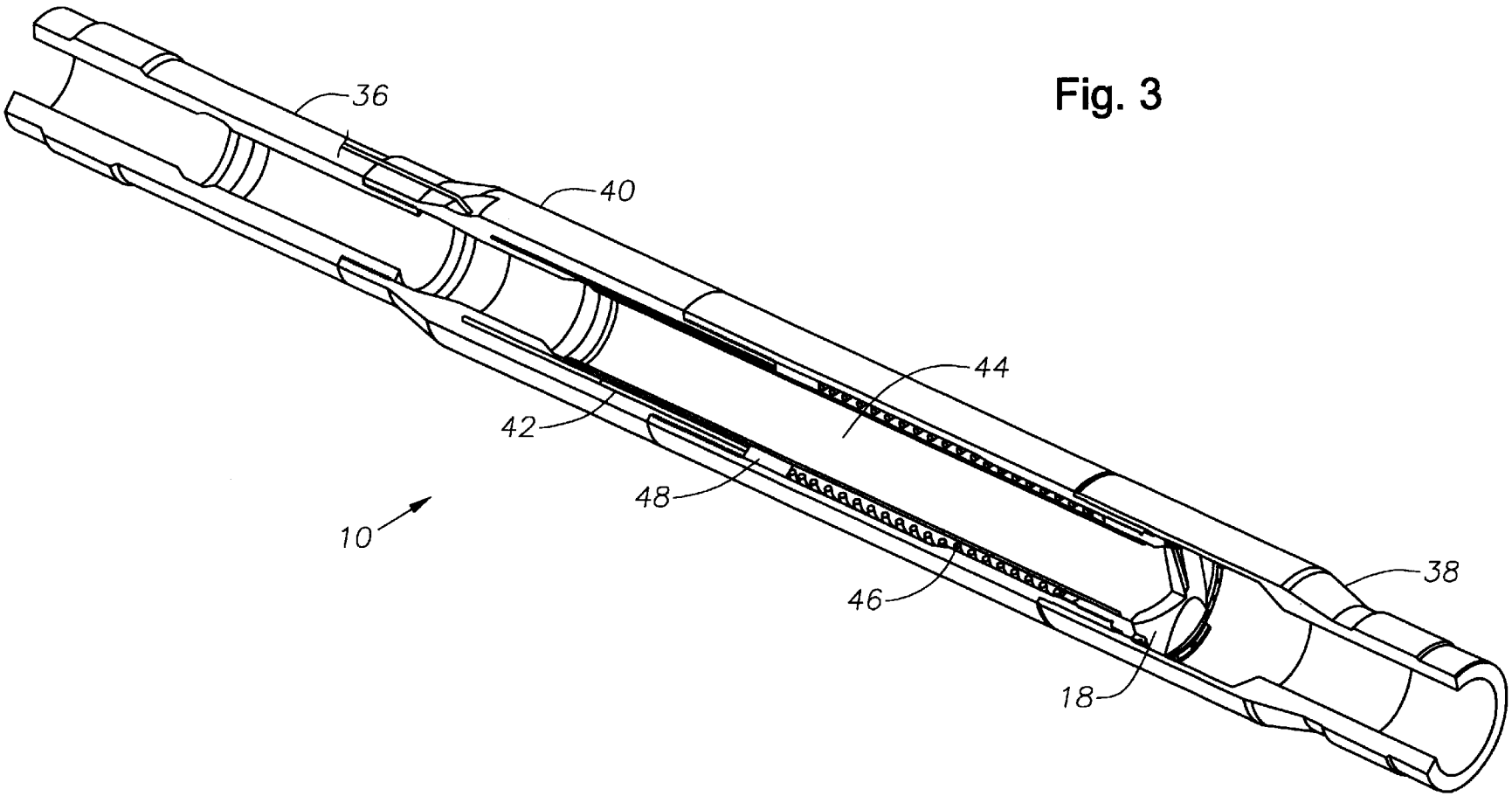
FIG. 3 is an isometric view, in partial section, of a tubing retrievable subsurface safety valve of the present invention shown in the closed position.

FIG. 3 presents the safety valve of the present invention in its closed position. In this position, the flapper 18 is blocking the wellbore. A power spring 46 is shown in its fully compressed position acting on a connecting means 48, allowing the power spring 46 to bias the flow tube to an upward position.

When pressure (or energy) is released from the piston 42 as shown in FIG. 3, the power spring 46 moves the flow tube 44 longitudinally upward, allowing the flapper closure mechanism 18 to close, and thereby preventing flow from the well.

Figure 4:
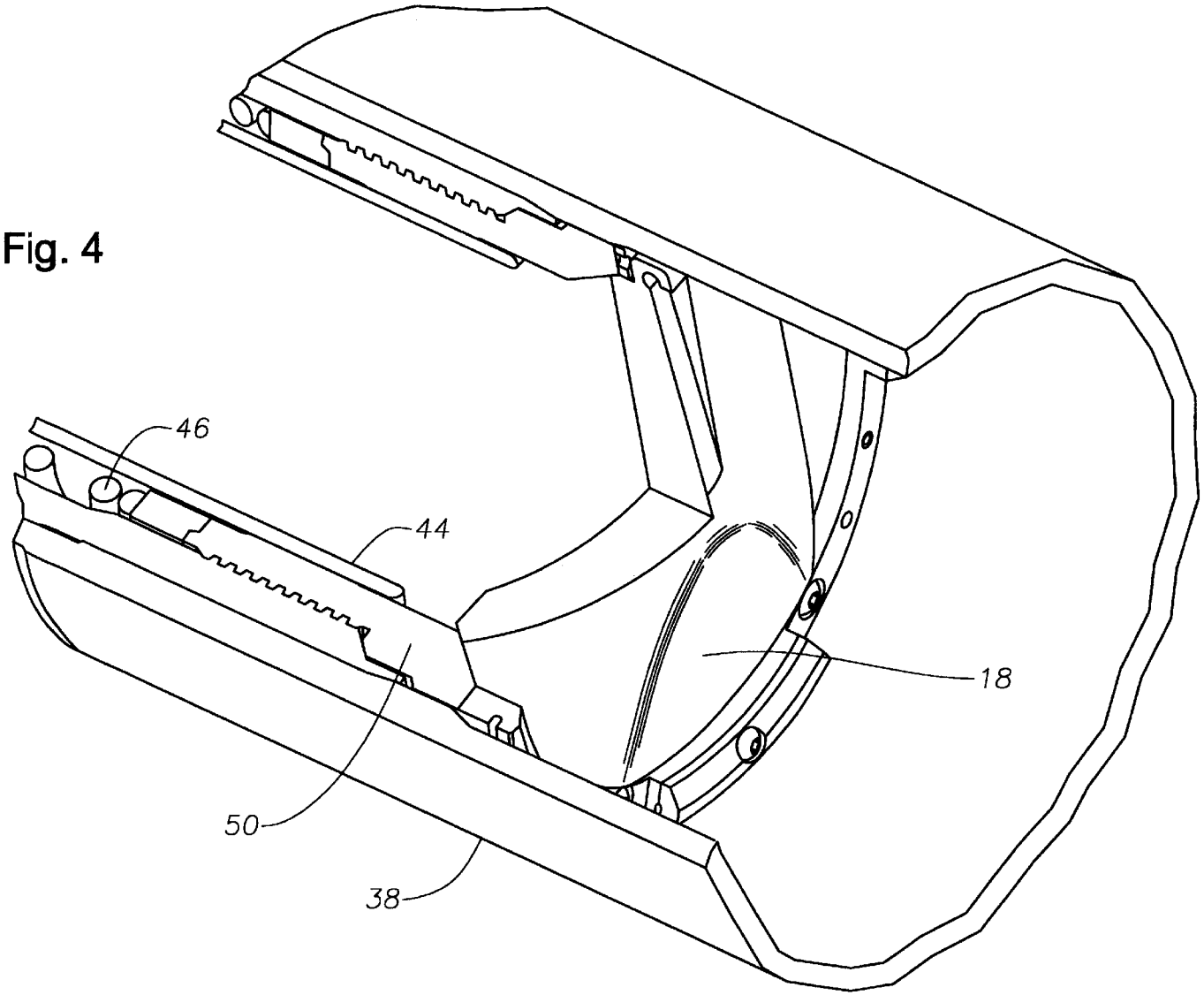
FIG. 4 is a close-up detailed isometric view, in partial section, of a flapper and seat in the all-metal configuration (without a soft seat) in a subsurface safety valve of the present invention, shown in the closed position.

FIG. 4 depicts, in quarter section, a close up view of a portion of the closed subsurface safety valve 10 of FIG. 3.

Features illustrated are the flow tube 44, a lower end of the power spring 46, and the flapper closure mechanism 18, all arranged inside the lower sub 38.

Figure 5:
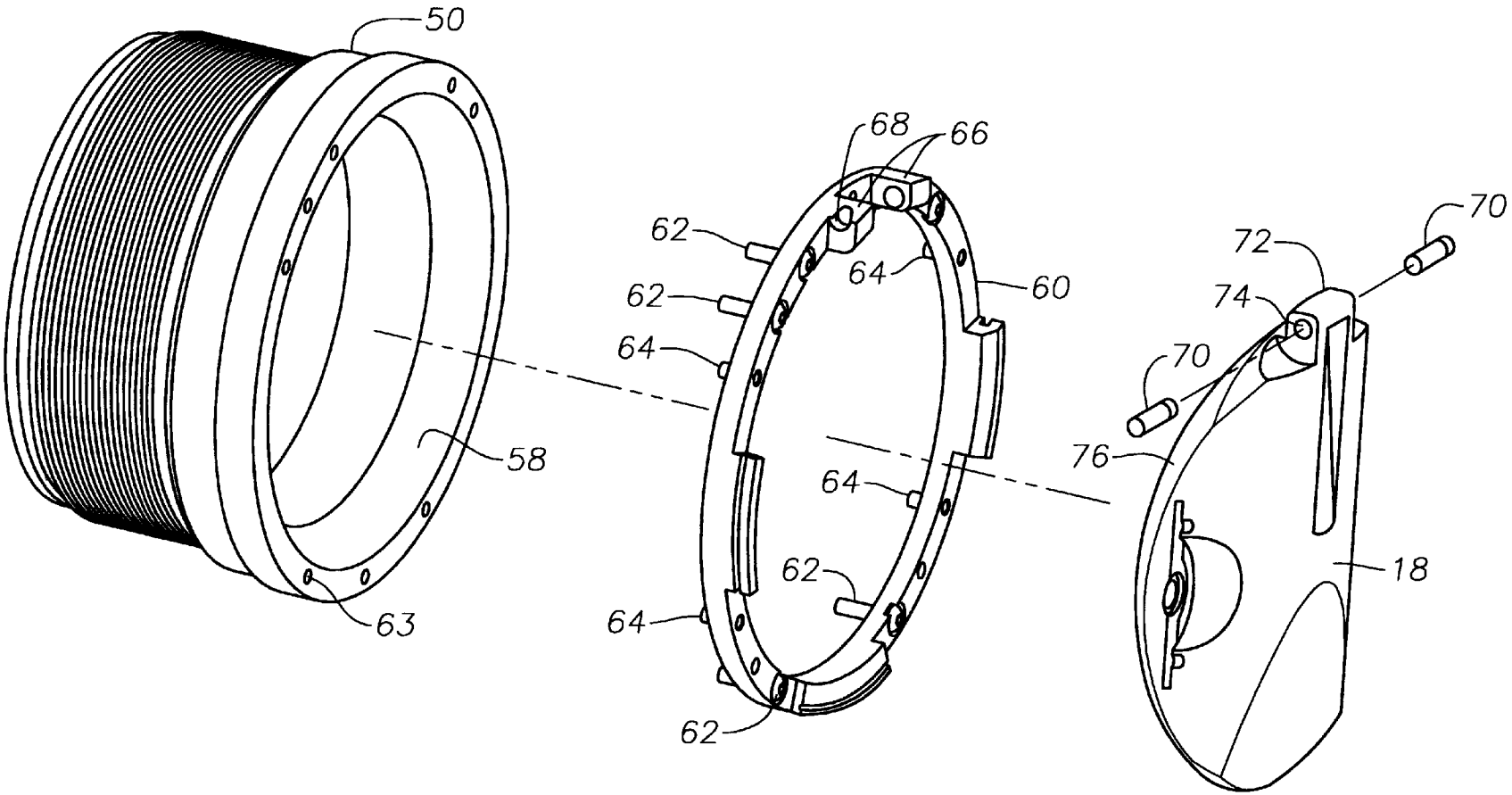
FIG. 5 is an exploded isometric view of a flapper/seat subassembly of the present invention, shown in the closed position and without a soft seat.

Referring now to FIG. 5, FIG. 5 presents an exploded isometric view of a flapper/seat subassembly of the present invention. The flapper 18 is shown in the closed position with a metal-to-metal seal. A hard seat 50 adapted for use in a safety valve 10 has a concave conical sealing surface 58 formed therearound. A flapper mount 60 is affixed to the hard seat 50 by a plurality of attachment screws 62 threaded into a plurality of threaded holes 63. Close tolerance alignment pins 64 assure a precision alignment between a centerline of the flapper mount 60 and the hard seat 50. A clevis pair 66 is fashioned into the flapper mount 60 wherein a mounting hole 68 is drilled through for receiving at least one flapper pin 70. The curved flapper 18 is rotatably mounted on the at least one flapper pin 70 by a hinge 72, having pin hole 74 drilled therethrough. Thus, the flapper 18 pivots between its open and closed positions about the flapper pin 70.

In operation, the curved flapper 18 swings in an arc of substantially 80–90 degrees between its opened and closed positions about the pin 70. In its open position, the flapper 18 is positioned essentially vertically so as not to obstruct the upward flow of hydrocarbons from the well. In its closed position, the flapper 18 seals essentially horizontally within the well so as to obstruct the upward flow of fluids. The flapper 18 is configured to meet a sealing surface 58 in the seat 50. In the arrangement shown in FIG. 5, the flapper 18 includes a convex spherical sealing surface which engages a corresponding convex spherical sealing surface in the seat 50.

The convex spherical sealing surface 76 formed on the curved flapper 18 results in a slightly elliptical flapper shape. FIGS. 16–19 more clearly depict the elliptical shape.

Figure 6:
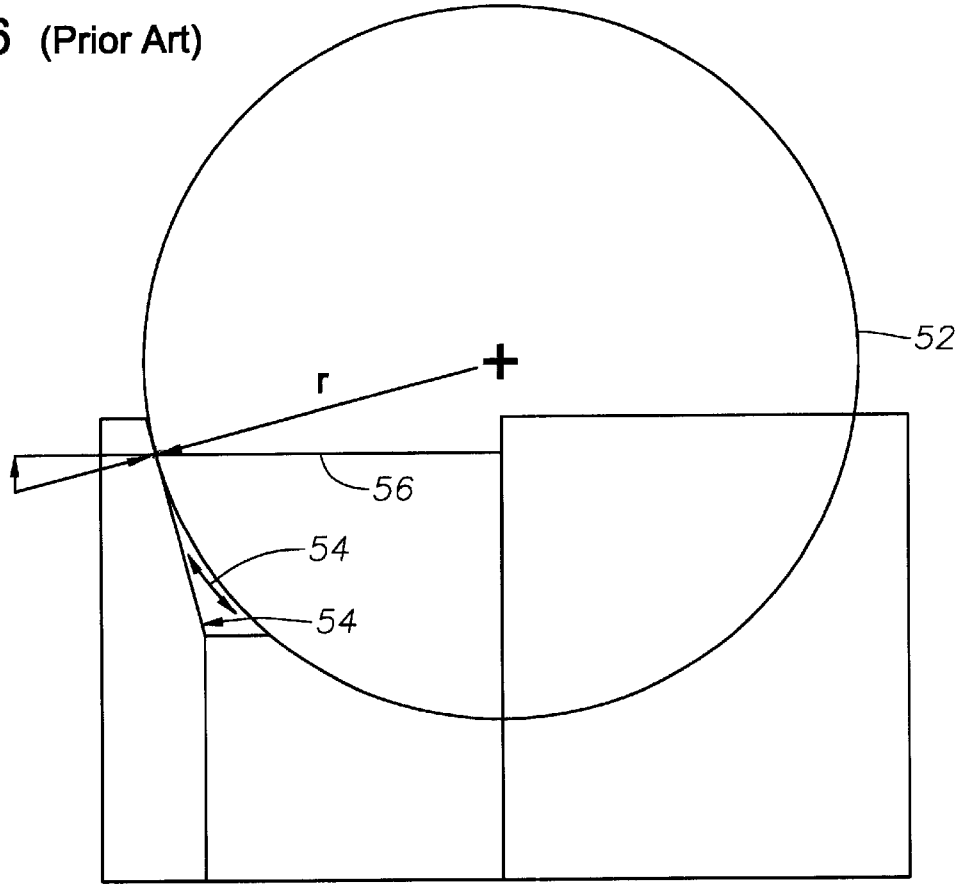
Fig. 6 (Prior Art)
FIG. 6 illustrates a sphere and cone sealing method and seal interface line in accordance with prior art.

The geometrical configurations of the sealing surfaces 58, 76 in the present invention are complex. Visualization of the complexity of this geometry in a two dimensional environment for most requires illustration of a simpler and well-known sealing device. Reference is thus made to the sealing device often employed in "poppet type" valves. FIG. 6 shows a simplified prior art arrangement of a convex spherical poppet seal 52 and a convex conical seat 54, the sealing surface of the seat being tangent to the spherical radius of the poppet seal 52. The interface between the spherical poppet 42 and the convex conical seat 54 forms a flat circular sealing line 56. Pressure forces acting on the spherical poppet 42 creates very high local stresses along the sealing line 56, thereby affecting a fluidic seal along the flat circular sealing line 56. The seating line 56 represents every point on the convex conical seat 54 that is tangent to the surface of the spherical poppet seal 52. Visualizing this tangency is helpful in understanding the geometry of the present invention. The flapper and seat seal of the present invention is related to the ball and cone poppet seal, but is more complex. The flat circular sealing line 56 of the poppet seal will not transcribe onto the geometry of a curved flapper with a spherical sealing segment. In this respect, the curved flapper is designed to maximize the inside diameter of a SCSSV.

In recent years, engineers and designers have employed highly advanced computerized software known generically as parametric solid modeling. Parametric solid modeling software is marketed under various brand names including: PRO-ENGINEER™, SOLID WORKS™, and SDRC-IDEAS™. Use of such software allows the designer to create and visualize geometries that are difficult or even impossible to describe in two-dimensional media, including two-dimensional drawings. Manufacturers first realized the difficulty where traditional drawings could not be used to either build or inspect parts. Means were created to translate the computerized electronic geometry directly to machine code. This increases capability, and efficiency and saves time over manufacturing processes that require drawings. It also provides the only means for reliably manufacturing a flapper and seat arrangement of the present invention.

Figure 7:
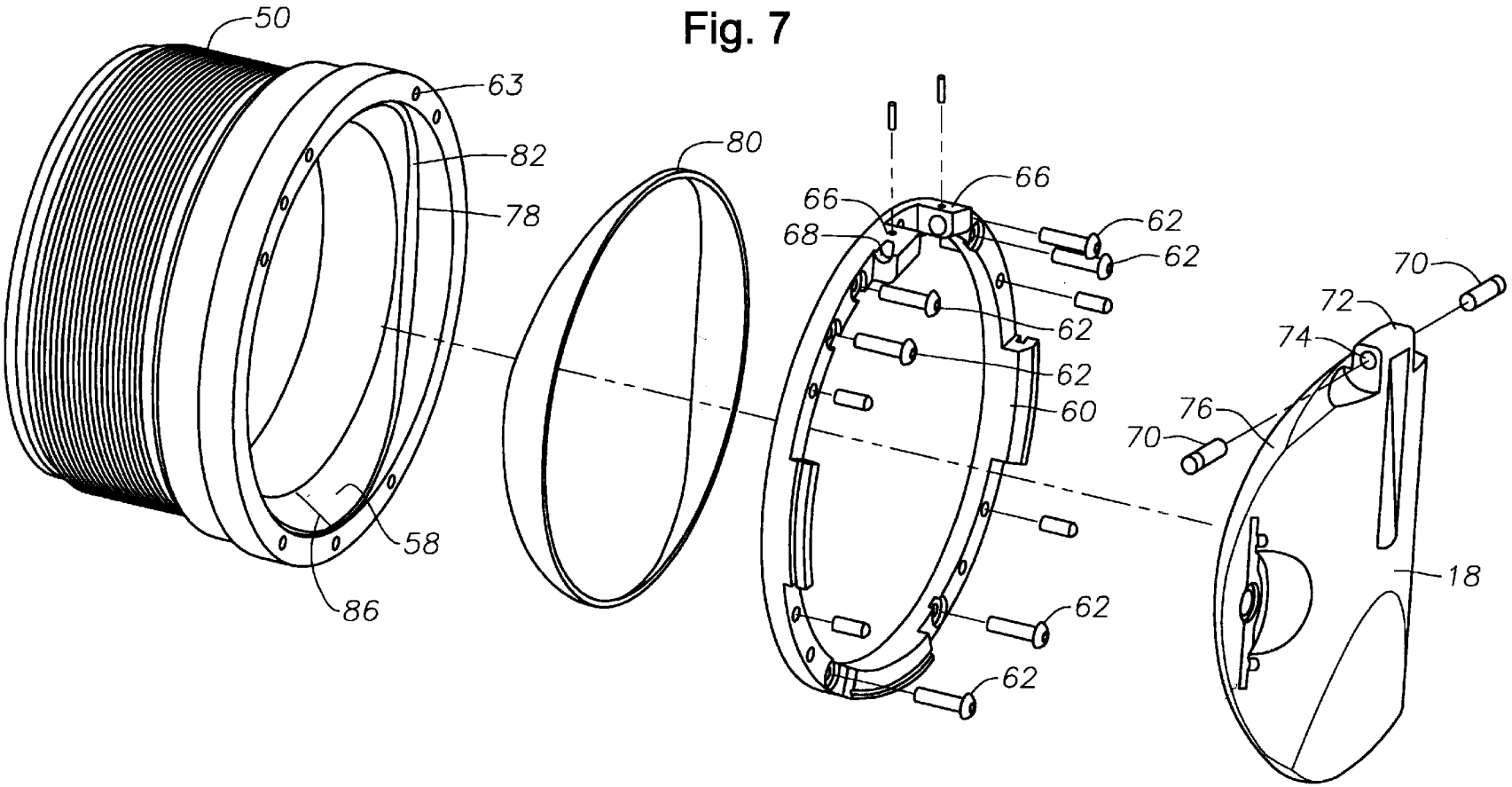
FIG. 7 is an exploded isometric view of a flapper/seat subassembly of the present invention, shown in the closed position and with a combination soft/hard seat.

The present invention, and specifically the interaction of the convex spherical sealing surface 76 and the concave conical sealing surface on the hard seat 50, can more easily be visualized in the "soft seat" embodiment hereinafter described in FIG. 7.

In FIG. 7, the hard seat 50 again has a concave conical sealing surface 58. However, it also has a seat recess 78 for receiving a soft seat 80. As before, flapper mount 60 is affixed to the hard seat 50 by a plurality of attachment screws 62 threaded into a plurality of threaded holes 63. Close tolerance alignment pins 64 assure a precision alignment between a centerline of the flapper mount 60 and the hard seat 50. A clevis pair 66 is fashioned into the flapper mount 60 wherein a mounting hole 68 is drilled through for receiving at least one flapper pin 70. The curved flapper closure mechanism 18 is rotatably mounted on the at least one flapper pin 70 by a hinge 72, having pin hole 74 drilled therethrough.

In operation, the curved flapper closure mechanism 18 pivots in an arc of substantially 80–90 degrees between its opened and closed positions about the pin 70. The concave conical sealing surface 58 of the seat 50 is adapted to receive the closed flapper closure mechanism 18 of the present invention upon which a convex spherical sealing surface 76 is formed.

The interaction between the concave conical sealing surface 58 of the seat 50 and the convex spherical sealing surface 76 of the flapper 18 is along a pair of sinusoidal sealing lines. First, a hard sinusoidal sealing line 82 is formed in the hard seat 50; second, a soft sinusoidal sealing line 84 is formed on the soft seat 80. Not obvious in this figure is the "angle" of the concave conical sealing surface. A single conical angle is represented by line 86. In order to provide the desired seal with the flapper 18, this conical angle 86 must be substantially tangent to a flapper sealing line 88 on the convex spherical sealing surface of the flapper 18. It must also be substantially tangent to a sinusoidal sealing line 82 formed in the hard seat 50 and the soft sinusoidal sealing line 84 formed on the soft seat 80. (The flapper sealing line 88 is illustrated in FIGS. 16–19.) This means that the conical angle 86 depicted must be variable circumferentially around a cross-sectional perimeter of the hard seat 50.

As earlier discussed, the variable conical angle 86 cannot be accurately depicted in this 2-D format. Computer software was used to generate the required solid model geometry to depict the part, as well as the machining code necessary to manufacture the part. A Coordinate Measuring Machine or CMM may be used to inspect manufactured parts for accuracy. For purposes of this disclosure, it must be understood that the angle of intersection between the sealing surfaces 58, 76 varies along the perimeter of the flapper 18.

When it becomes necessary to close, the flapper 18 rotates about the pin 70 until it begins to nest in the hard seat. The flapper sealing line 88 on the convex spherical sealing surface 76 first contacts the sinusoidal sealing line 84 formed on the soft seat 80. This interaction allows for an effective seal at low pressures. The soft seal 80 is fabricated from a resilient material. Preferably, the resilient seat is constructed of an elastomeric material having a durometer hardness in the range of 60 to 99. Other materials, however, are satisfactory for the soft seat 80. Acceptable examples include a thermoplastic polymeric material, e.g., tetrafluoroethylene (TFE) fluorocarbon polymer or polyetheretherketone (PEEK), a reinforced thermoplastic containing carbon or glass, or a soft metallic material, e.g., lead, copper, zinc, gold or brass.

At higher pressures, the resilient nature of the soft seat material deforms. The flapper sealing line 88 on the flapper seating surface 76 engages the sinusoidal sealing line 82 formed in the hard seat 50. This interaction allows for a high-pressure seal. Forces along the sinusoidal sealing line due to pressure are resolved very efficiently in the present invention. The reactive force from the hard seat normal to the sinusoidal sealing line inhibits and virtually eliminates the metaphorically descriptive "Taco Effect", or tendency of prior art curved flappers to bend like the familiar food item when subjected to high pressure. Any such bending in a flapper can cause undesirable leakage and possible failure. The present invention also resolves stresses in the flapper and seat in a very efficient manner.

Figure 8:
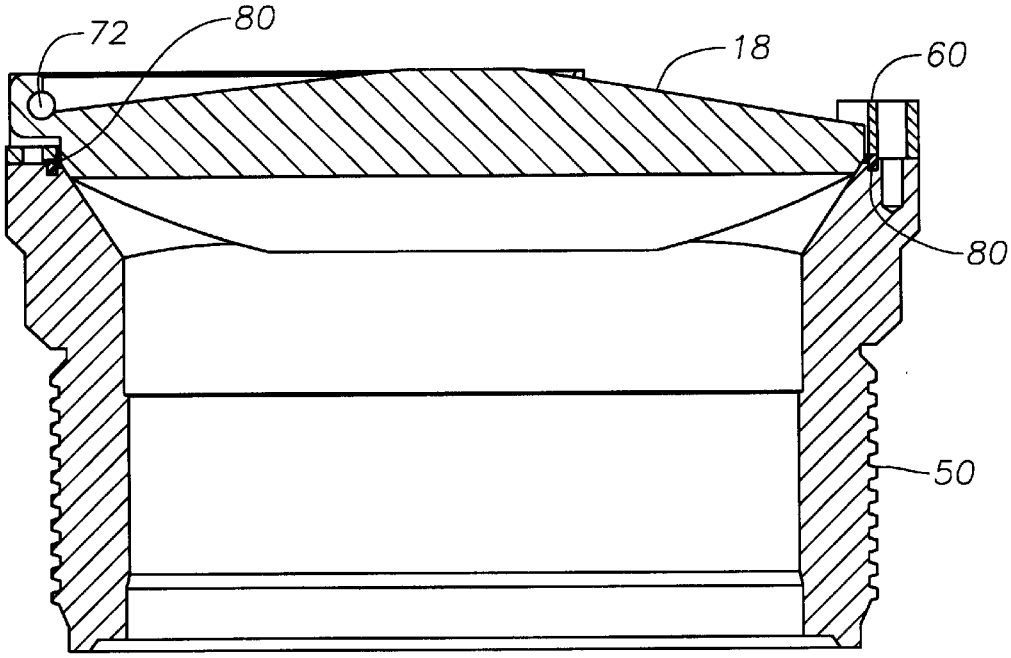
FIG. 8 is a cross-sectional view of a flapper/seat subassembly of the present invention, shown in the closed position and with soft seat/hard seat configuration.
Figure 9:
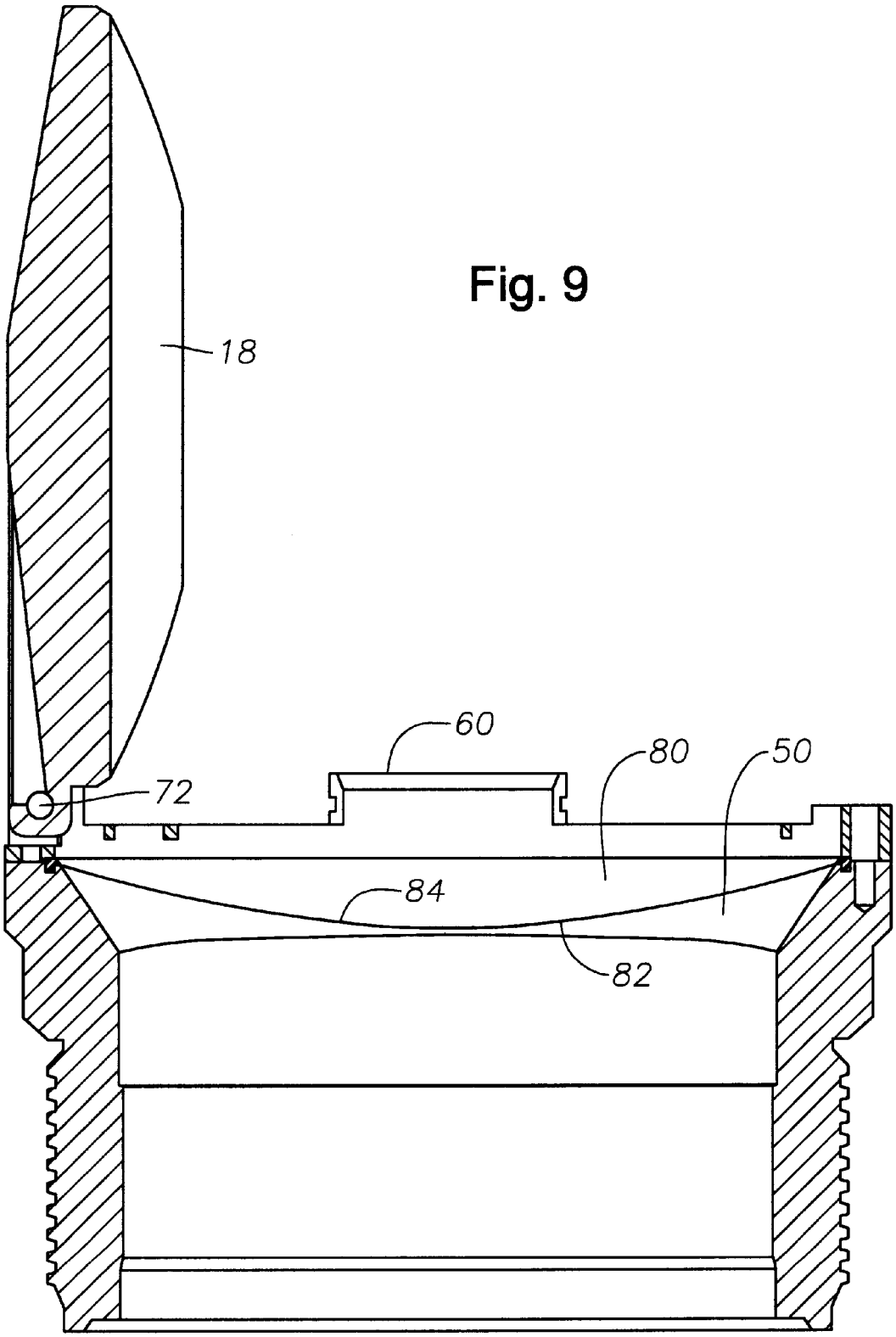
FIG. 9 is a cross-sectional view of a flapper/seat subassembly of the present invention, shown in the open position and with the soft seat/hard seat configuration.

Reference is now made to FIGS. 8 and 9. FIGS. 8 and 9 present cross-sectional views of a flapper 18 of the present invention, along with a resilient soft seat 80, the hard seat 50, the flapper mount 60, and the hinge 72. In FIG. 8, the flapper 18 is in its closed position. In FIG. 9, the flapper 18 is shown in the open position. FIG. 9 also clearly shows an interface between the hard sinusoidal seating line 82 and the soft sinusoidal seating line 84.

Figure 10:
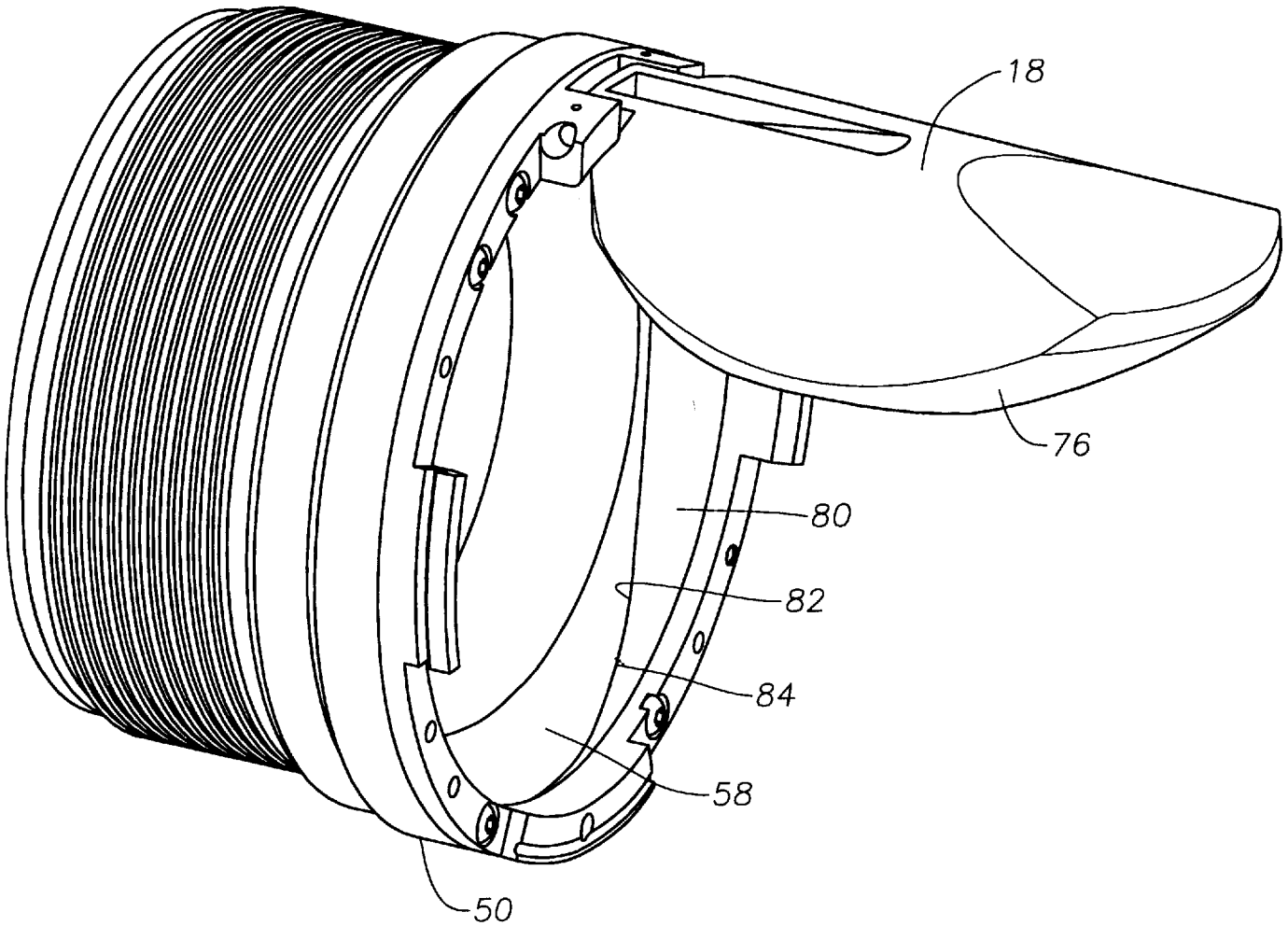
FIG. 10 is an isometric view of a flapper and seat in the soft seat/hard seat configuration of the present invention shown in the open position, incorporated into a substrate safety valve.

FIG. 10 provides an assembled isometric view of a flapper closure mechanism 18, a hard seat 50, and a soft seat 80 for use in a subsurface safety valve 10 of the present invention, shown in the open position. Also visible in this view is an interface between the hard sinusoidal seating line 82 and the soft sinusoidal seating line 84, as well as the convex spherical sealing surface 76 on the flapper 18.

Figure 11:
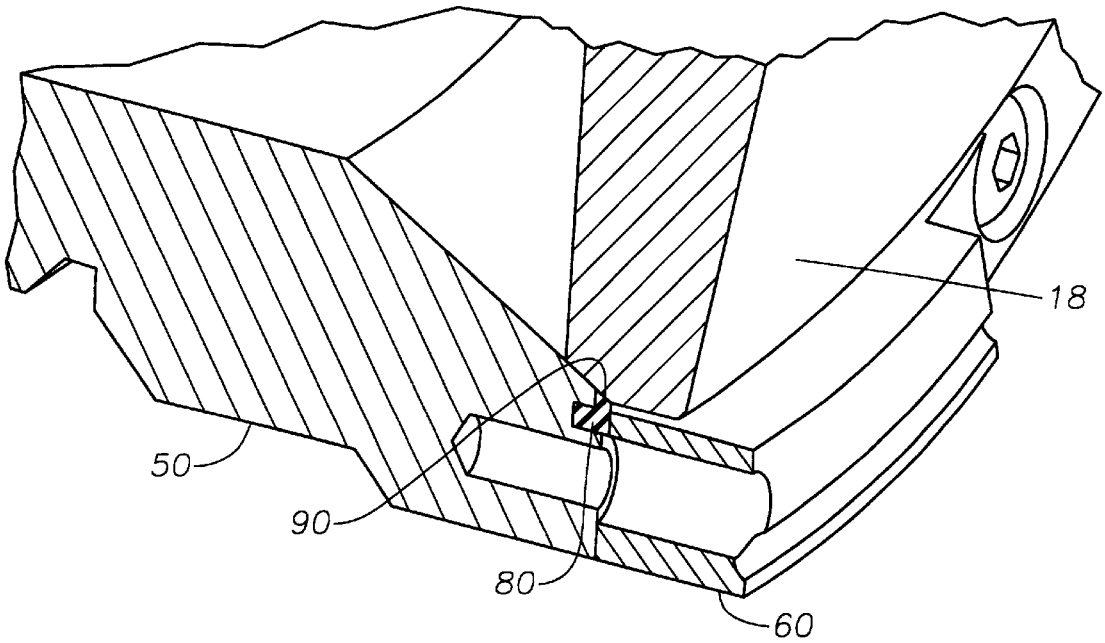
FIG. 11 is a close-up detailed isometric view, in partial section, of a flapper and seat in the soft seat/hard seat configuration of the present invention shown in the closed position, incorporated into a subsurface safety valve.

FIG. 11 is a close-up detailed isometric view, in partial section, of a flapper closure mechanism 18, a hard seat 50, and a soft seat 80 for use in a subsurface safety valve of the present invention. In this view, the valve 10 is shown in the closed position. The soft seat 80 is configured to protrude above the hard seat 50. As the flapper 18 closes, the resilient soft seat 50 initially engages the flapper 18 to provide a low-pressure seal. As pressure increases, the flapper closure mechanism 18 moves to contact the hard seat 50, thereby providing the valve with a high-pressure seal.

Figure 12:
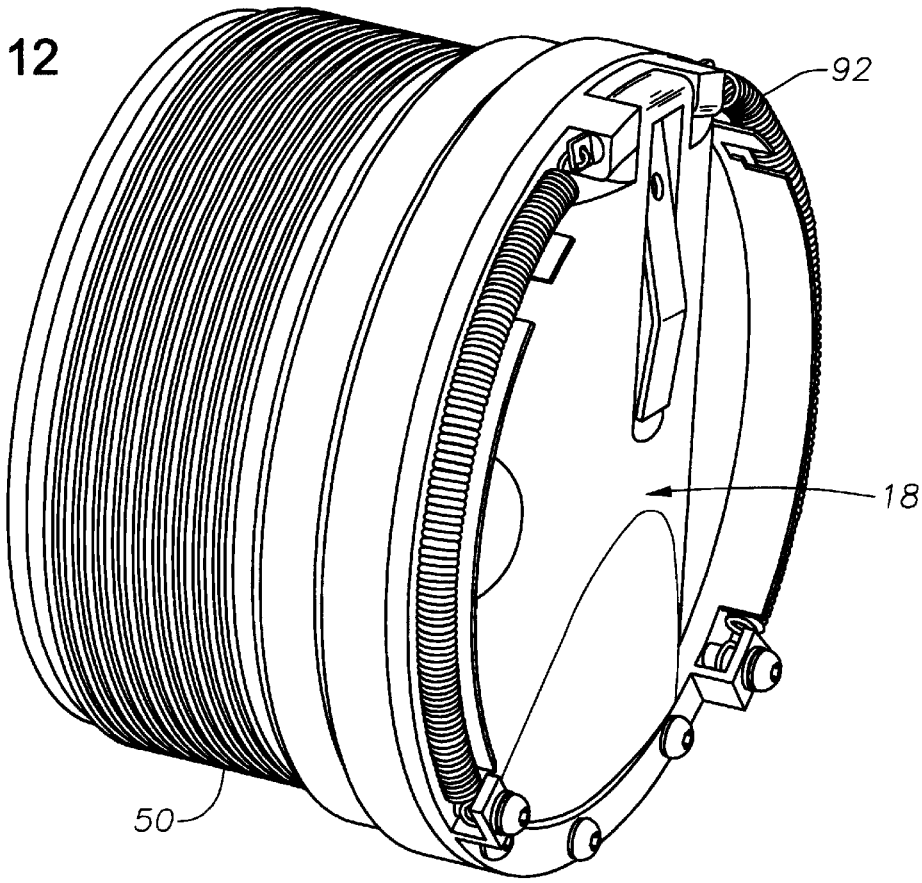
FIG. 12 is an isometric view of a flapper and seat in the soft resilient seat/hard seat configuration in a subsurface safety valve of the present invention shown in the closed position with a flapper closing means.

FIG. 12 is an assembled isometric view of a safety valve of the present invention, shown in the closed position. A flapper spring means 92 for biasing the flapper 18 to the closed position is seen. One of ordinary skill in the art of safety valve design will understand that there are many well-known means to bias a flapper 18 to the closed position. Use of any type of spring means to close the flapper 18 of the present invention is regarded within the scope and spirit of the present invention.

Figure 13:
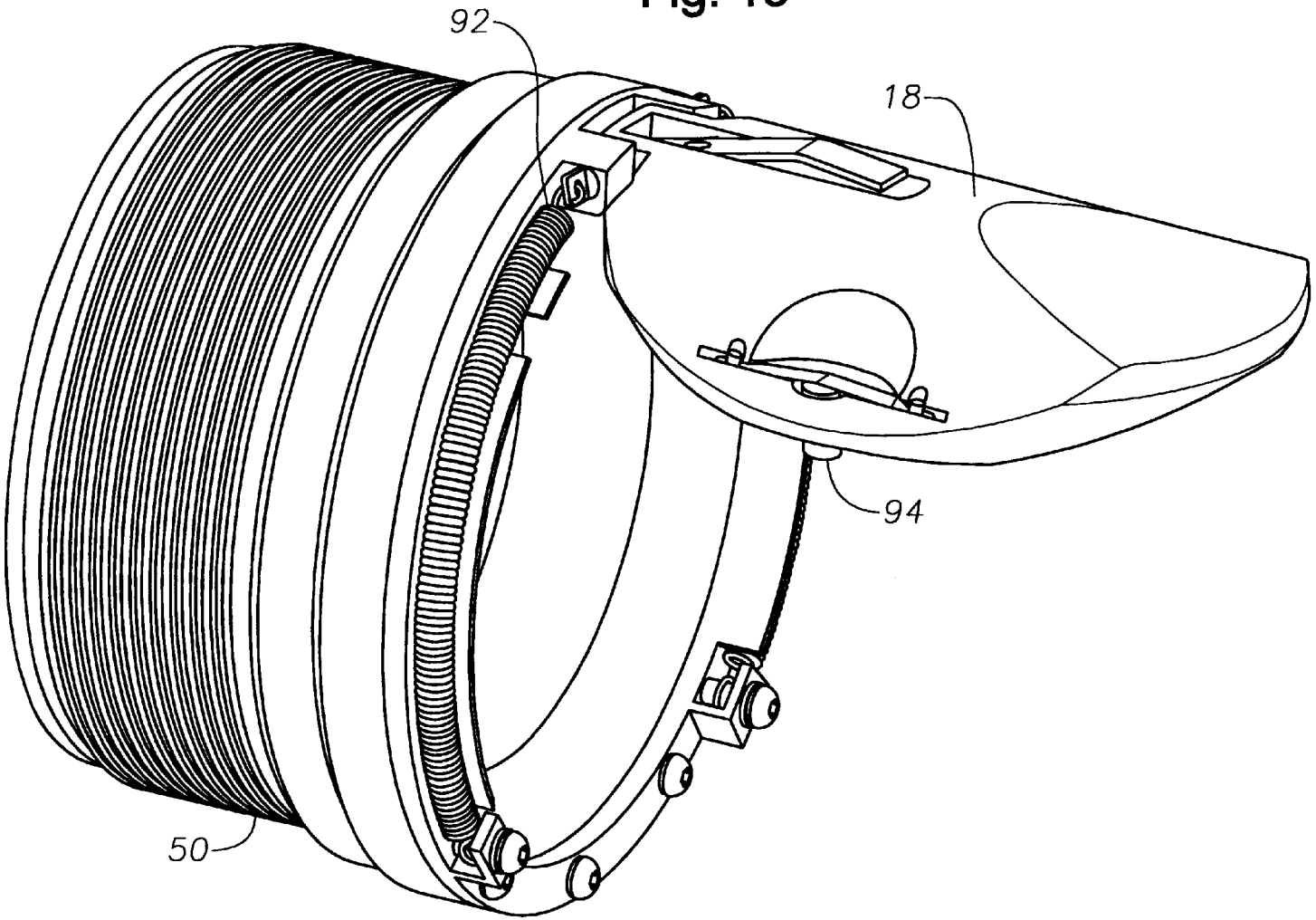
FIG. 13 is an exploded isometric view of a metal-to-metal flapper and seat in a subsurface safety valve of the present invention shown in the open position with a flapper closing means and an equalizing means.

FIG. 13 is an assembled isometric view of the safety valve of FIG. 12, shown in the open position. A flapper spring means 92 for biasing the flapper closure mechanism 18 to the closed position is again shown. Also depicted, is an optional equalizing valve means 94. In FIG. 13, the pressure equalizing means 94 is a dart.

The equalizing means 94 shown in FIG. 13 is a well-known device for equalizing differential pressures across the flapper 18 When the flapper 18 is closed, pressure builds up below, and acts on the flapper's surface area. This pressure force may be as high as 20,000 psig. This amount of force is too great for the flow tube 44 to overcome. Therefore, a means of equalizing pressure is required in order for the flapper 18 to open. When it becomes necessary to open the SCSSV, the flow tube 44 (not shown in this view) translates downward and contacts the dart 94. Dart 94 includes an opening which permits fluid to bleed through the valve 10, thereby equalizing pressure above and below the flapper 18. When pressure substantially equalizes across the flapper 18, the flow tube 44 translates axially downward and fully opens the SCSSV.

Figure 14:
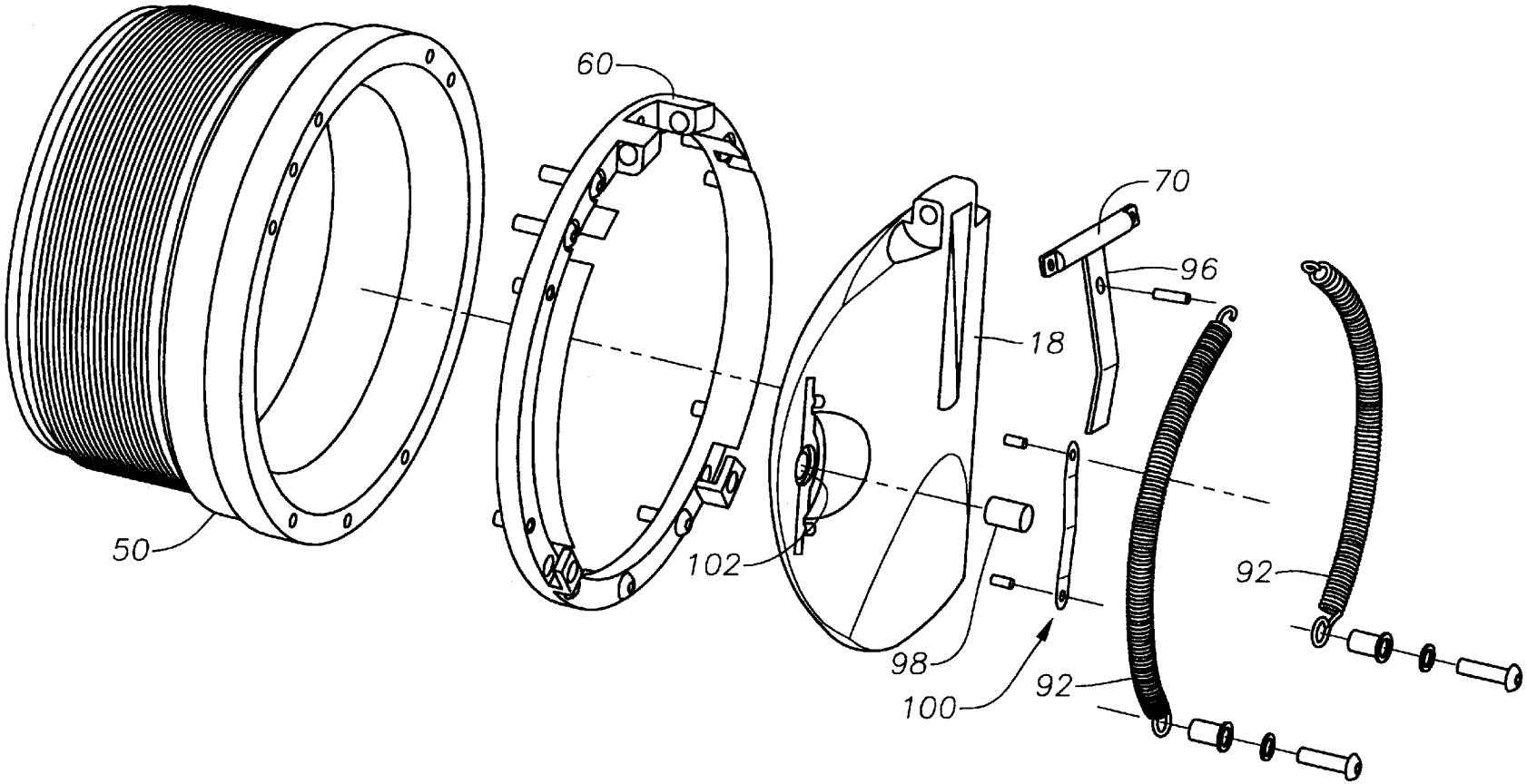
FIG. 14 is an exploded isometric view of a metal-to-metal flapper and seat in a subsurface safety valve of the present invention shown in the closed position with a flapper closing means and an equalizing means.

FIG. 14 is an exploded isometric view of a safety valve 10 of the present invention, shown in the closed position. The valve 10 also includes a pressure equalizing means 94. The valve 10 of FIG. 14 utilizes metal-to-metal contact between the flapper 18 and the seat 50. Visible are the flapper mount 60, the flapper pin 70, a leaf spring 96, an equalizing dart 94, and at least one dart spring 100. A hole 102 is machined through the flapper for receiving the dart 98. The at least one dart spring 100 biases the dart 94 to a closed position.

Figure 15:
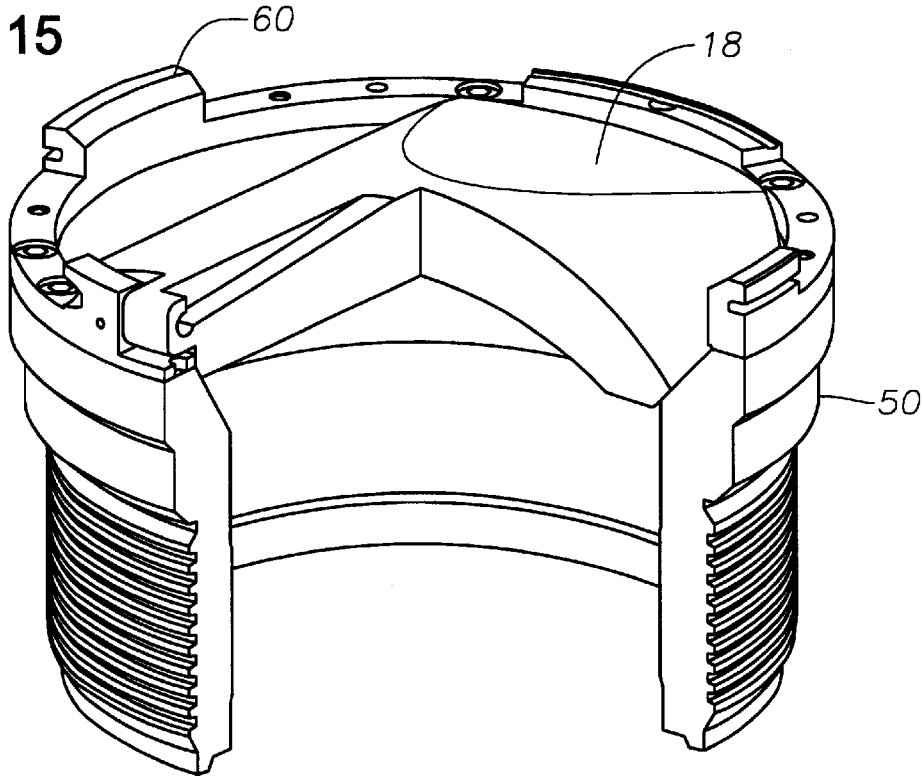
FIG. 15 is an enlarged isometric view of a closed flapper/seat subassembly in partial section, which illustrates details of the all-metal flapper and seat of the present invention.
Figure 16:
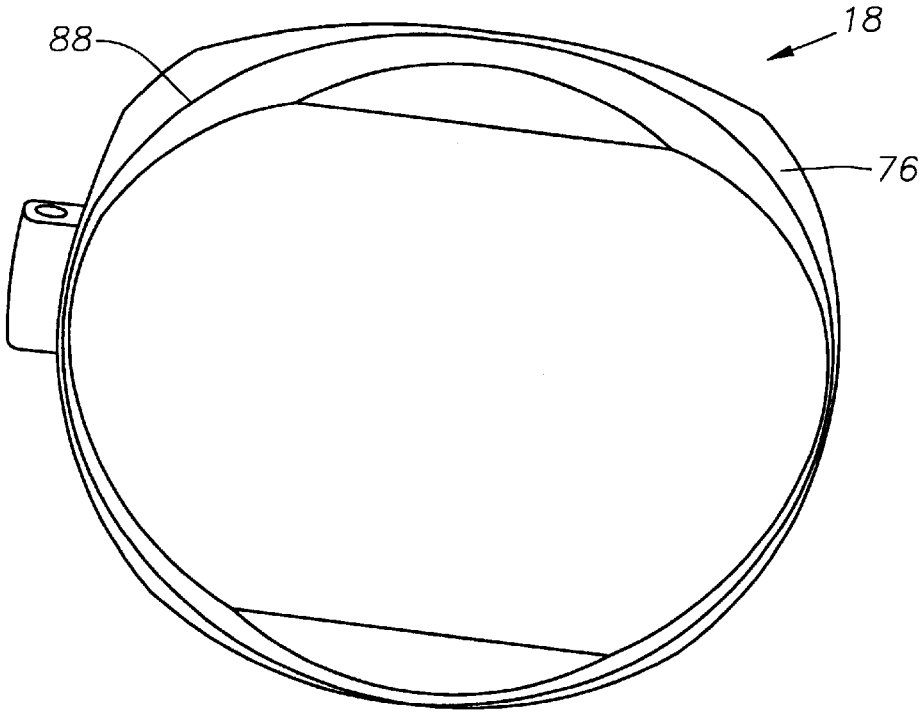
FIGS. 16, 17, 18 and 19 are rotated isometric views of the flapper closure mechanism.
Figure 17:
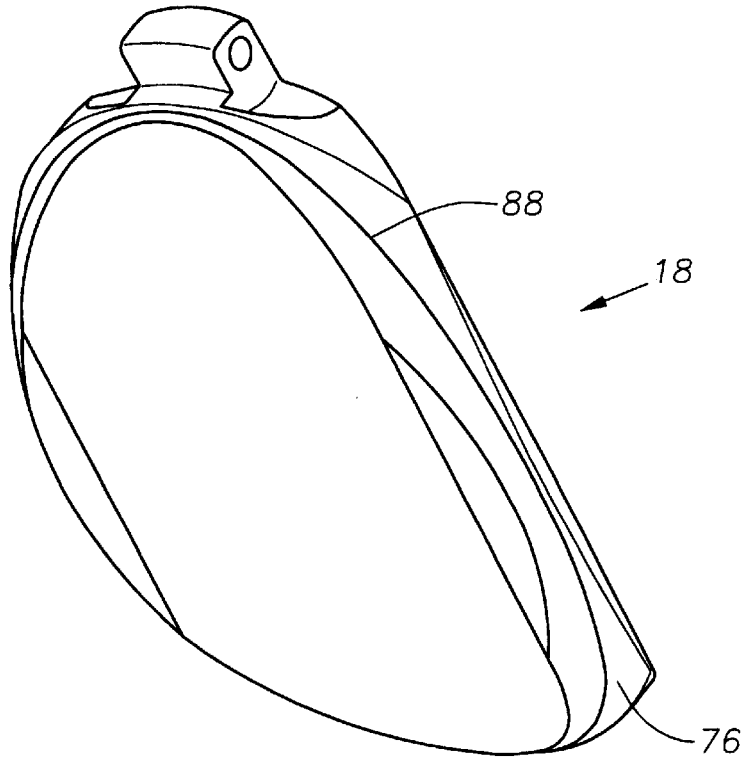
Figure 18:
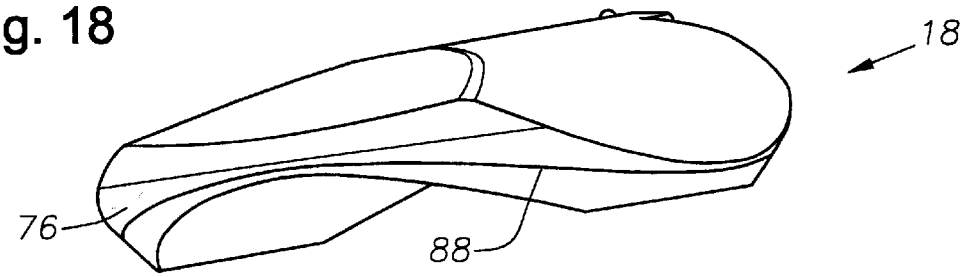
Figure 19:
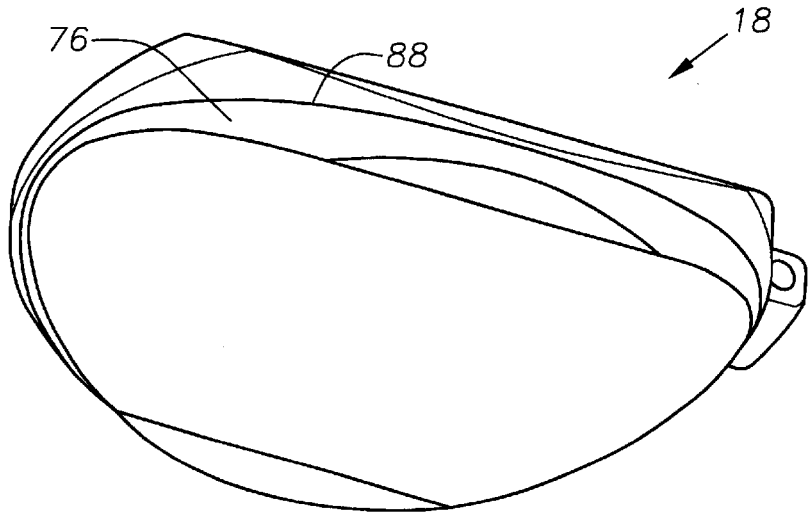

FIG. 15 is an enlarged isometric view of a flapper 18, a hard seat 50, and a flapper mount 60. This Figure illustrates details of the all-metal flapper and seat engagement of the present invention, in one aspect.

FIGS. 16, 17, 18, and 19 are rotated isometric views of the curved flapper 18 used in a valve 10 of the present invention. These Figures show the substantially elliptical shape of flapper 18. Also shown in these rotated views are the convex spherical sealing surface 76 of the flapper 18, and the sinusoidal shape of the flapper sealing line 88.

It should be noted that while a tubing retrievable embodiment is shown and discussed herein, the curved flapper and seat of the present invention might also be adapted for use in a wireline retrievable subsurface safety valve. Operation of the tubing retrievable subsurface safety valve 10 is otherwise in accord with the operation of any surface controllable, wireline retrievable safety valves that employ this invention.

Although the invention has been described in part by making detailed reference to specific embodiments, such detail is intended to be and will be understood to be instructional rather than restrictive. As has been described in detail above, the present invention has been contemplated to overcome the deficiencies of the prior equalizing safety valves specifically by improving the sealing capabilities of curved flapper subsurface safety valves.

Whereas the present invention has been described in relation to the drawings attached hereto, it should be understood that other and further modifications, apart from those shown or suggested herein, might be made within the scope and spirit of the present invention.

What is claimed is:

1. A subsurface safety valve for controlling fluid flow in a wellbore, comprising:

a tubular member having a longitudinal bore extending therethrough;

a curved flapper having a convex spherical sealing surface, the flapper pivoting within the tubular member between an open position and a closed position; and a seat affixed to the tubular member having a concave conical sealing surface for sealingly receiving the sealing surface of the flapper along a sinusoidal seating line, thereby preventing fluid flow through the longitudinal bore when said flapper is in its closed position.

2. The subsurface safety valve of claim 1, wherein the seat is a hard seat fabricated from a metal alloy.

3. The subsurface safety valve of claim 2, further comprising an actuator mechanism for selectively opening the flapper within the tubular member.

4. The subsurface safety valve of claim 3, wherein the curved flapper is biased to a normally closed position to prevent fluid flow upward through the longitudinal bore of the tubular member.

5. The subsurface safety valve of claim 4, wherein the actuator mechanism comprises a hydraulically actuated piston which acts upon a flow control tube residing within the tubular member to selectively open and close the curved flapper.

6. The subsurface safety valve of claim 2, further comprising a resilient seat residing concentrically within the metallic hard seat proximate the sinusoidal sealing line.

7. The subsurface safety valve of claim 6, wherein the resilient seat is constructed of an elastomeric material.

8. The subsurface safety valve of claim 7, wherein the elastomeric material has durometer hardness in the range of 60–99.

9. The subsurface safety valve of claim 6, wherein the resilient seat is constructed of a thermoplastic polymeric material.

10. The subsurface safety valve of claim 9, wherein the thermoplastic material is tetrafluoroethylene fluorocarbon polymer.

11. The subsurface safety valve of claim 9, wherein the thermoplastic material is Polyetheretherkeytone.

12. The subsurface safety valve of claim 9, wherein the thermoplastic material is reinforced thermoplastic containing carbon.

13. The subsurface safety valve of claim 9, wherein the thermoplastic material is reinforced thermoplastic containing glass.

14. The subsurface safety valve of claim 6, wherein the resilient seat is constructed of a soft metallic material.

15. The subsurface safety valve of claim 14, wherein the soft metallic material is selected from the group consisting of lead, copper, zinc, gold and brass.

16. The subsurface safety valve of claim 6, further comprising a pressure equalizing valve for permitting fluid to bleed through the flapper when the actuator mechanism is actuated, thereby equalizing any pressure differential across the flapper and enabling the flapper to open.

17. The subsurface safety valve of claim 6, further comprising an actuator mechanism for selectively opening the flapper within the tubular member.

18. The surface safety valve of claim 17, wherein the curved flapper is biased to a normally closed position to prevent fluid flow upward through the longitudinal bore of the tubular member.

19. The subsurface safety valve of claim 18, wherein the actuator mechanism comprises a hydraulically actuated piston which acts upon a flow control tube residing within the tubular member.

20. The subsurface safety valve of claim 19, wherein the resilient seat is disposed within the metallic hard seat such that the flapper contacts the resilient seat before contacting the hard seat when the flapper is moved from its open position to its closed position.

21. The surface safety valve of claim 1, wherein the sealing surface of the flapper is configured to contact the sealing surface of the seat along the sinusoidal seating line such that the reactive force from the seat is normal to the sinusoidal seating line.

22. The surface safety valve of claim 1, wherein the concave conical sealing surface of the seat has an angle that is variable circumferentially around a cross-sectional perimeter of the seat.

23. A curved flapper for a wellbore safety valve, the curved flapper pivoting between an open position and a closed position, and the curved flapper engaging a seat in the safety valve so as to inhibit the upward flow of fluids in the wellbore when the flapper is in its closed position, the curved flapper having a sealing surface for engaging a corresponding sealing surface on the seat when the flapper is in its closed position, the sealing surface of the flapper being configured to contact the sealing surface of the seat along a sinusoidal seating line such that the reactive force from the seat is normal to the sinusoidal seating line.

24. The curved flapper of claim 23, wherein the sealing surface of the flapper is proximate to the perimeter of the curved flapper.

25. The curved flapper of claim 24, wherein the sealing surface of the flapper is convex and spherical in shape relative to the seat.

26. The curved flapper of claim 25, wherein the sealing surface of the seat is concave and conical in shape relative to the flapper.

27. The curved flapper of claim 26, wherein the seat is a hard seat fabricated from a metal alloy.

28. The curved flapper of claim 23, wherein the sealing surface of the seat has an angle that is variable circumferentially around a cross-sectional perimeter of the seat.

29. In a tubing retrievable subsurface safety valve of the type having a tubular housing adapted for connection in a production tubing string and having an actuator formed therein, a valve closure assembly is disposed within a housing chamber, the valve closure assembly comprising a curved flapper moveable between an open and a closed position in response to the actuator for opening and closing a production flow passage, and a valve seat, the valve seat being characterized by a concave conical sealing surface, and the flapper being characterized by a convex spherical sealing surface, with the sealing surface of the flapper engaging the sealing surface of the seat along a sinusoidal seam.

30. The subsurface safety valve of claim 29, further comprising a resilient seat adapted to fit inside the concave conical sealing surface proximate the sinusoidal seam, wherein the flapper contacts the resilient seat before contacting the seat when closing.

31. The subsurface safety valve of claim 30, wherein the resilient seat is constructed of an elastomeric material.

32. The subsurface safety valve of claim 31, wherein the elastomeric material has durometer hardness in the range of 60–99.

33. The subsurface safety valve of claim 31, wherein the resilient seat is constructed of a thermoplastic polymeric material.

34. The subsurface safety valve of claim 33, wherein the thermoplastic material is tetrafluoroethylene fluorocarbon polymer.

35. The subsurface safety valve of claim 33, wherein the thermoplastic material is Polyetheretherkeytone.

36. The subsurface safety valve of claim 33, wherein the thermoplastic material is reinforced thermoplastic containing carbon.

37. The subsurface safety valve of claim 27, wherein the resilient seat is constructed of a soft metallic material.

38. The subsurface safety valve of claim 37, wherein the soft metallic material is selected from the group consisting of lead, copper, zinc, gold and brass.

39. The subsurface safety valve of claim 29, further comprising a pressure equalizing valve for permitting pressure to bleed through the flapper when the actuator is actuated, thereby equalizing any pressure differential across the flapper and enabling the flapper to open.

40. The surface safety valve of claim 29, wherein the concave conical sealing surface of the valve seat has an angle that is variable circumferentially around a cross-sectional perimeter of the valve seat.

41. A flapper valve assembly comprising, in combination:

a tubular valve seat body having a bore defining a fluid flow passage and having a primary valve seat sealing surface of metal substantially in the form of a concave conical segment disposed about the fluid flow passage;

a valve seat insert having an insert body portion;

an arcuate valve closure mechanism pivotally mounted on a hinge for preventing flow through the fluid flow passage when the closure mechanism is engaged against the seating surface; and, the valve closure mechanism having a sealing surface substantially in the form of a convex spherical segment for engaging the concave conical valve seat sealing surface forming a mutual sinusoidal sealing surface.

42. The flapper valve assembly of claim 41, further comprising a resilient seat residing concentrically within the concave conical valve seat proximate the sinusoidal sealing surface, wherein the flapper contacts the resilient seat before contacting the valve seat when closing.

43. The flapper valve assembly of claim 42, wherein the resilient seat is constructed of an elastomeric material.

44. The flapper valve assembly of claim 43, wherein the elastomeric material has durometer hardness in the range of 60–99.

45. The flapper valve assembly of claim 42, wherein the resilient seat is constructed of a thermoplastic polymeric material.

46. The flapper valve assembly of claim 45, wherein the thermoplastic material is tetrafluoroethylene fluorocarbon polymer.

47. The flapper valve assembly of claim 45, wherein the thermoplastic material is Polyetheretherkeytone.

48. The flapper valve assembly of claim 45, wherein the thermoplastic material is reinforced thermoplastic containing carbon.

49. The flapper valve assembly of claim 45, wherein the thermoplastic material is reinforced thermoplastic containing carbon.

50. The flapper valve assembly of claim 45, wherein the thermoplastic material is reinforced thermoplastic containing glass.

51. The flapper valve assembly of claim 42, wherein the resilient seat is constructed of a soft metallic material.

52. The flapper valve assembly of claim 51, wherein the soft metallic material is selected from the group consisting of lead, copper, zinc, gold, and brass.

53. The flapper valve assembly of claim 41, further comprising a pressure equalizing valve for permitting pressure to bleed through the flapper when the valve closure mechanism is being opened, thereby equalizing any pressure differential across the valve closure mechanism and enabling the valve closure mechanism to open.

54. The flapper valve assembly of claim 41, wherein the concave conical segment has an angle that is variable circumferentially around a cross-sectional perimeter of the valve seat.

* * * * *